United States Patent [19]

Schössler et al.

[11] 4,178,308

[45] Dec. 11, 1979

[54] PROCESS FOR THE PREPARATION OF 1-AMINO-8-NAPHTHOL-3,6-DISULPHONIC ACID (H-ACID)

[75] Inventors: Willi Schössler, Cologne; Horst Behre, Odenthal; Rolf Pütter, Duesseldorf, all of Fed. Rep. of Germany

[73] Assignee: Bayer Aktiengesellschaft, Leverkusen, Fed. Rep. of Germany

[21] Appl. No.: 920,033

[22] Filed: Jun. 28, 1978

[30] Foreign Application Priority Data

Jul. 16, 1977 [DE] Fed. Rep. of Germany ..... 2732291

[51] Int. Cl.[2] ..... C07C 143/66

[52] U.S. Cl. ..... 260/509

[58] Field of Search ..... 260/509

[56] References Cited

U.S. PATENT DOCUMENTS

| | | | |
|---|---|---|---|
| 458,286 | 8/1891 | Kuzel | 260/509 |
| 511,708 | 12/1893 | Moeller | 260/509 |
| 540,412 | 6/1895 | Ulrich et al. | 260/509 |
| 1,670,406 | 5/1928 | Gubelmann et al. | 260/509 |
| 4,130,581 | 12/1978 | Ross | 260/509 |

FOREIGN PATENT DOCUMENTS

| | | | |
|---|---|---|---|
| 2726127 | 12/1977 | Fed. Rep. of Germany | 260/509 |

*Primary Examiner*—Joseph E. Evans

*Attorney, Agent, or Firm*—Sprung, Felfe, Horn, Lynch & Kramer

[57] ABSTRACT

A process has been invented for the preparation of a mono-alkali metal salt of 1-amino-8-naphthol-3,6-disulphonic acid comprising reacting 1-naphthylamine-3,6,8-trisulphonic acid and/or a salt thereof and/or a naphthylamine-trisulphonic acid isomer mixture and/or salt thereof with an alkali metal hydroxide solution at elevated pressure and elevated temperature and in the presence of an alcohol or alcoholate, and separating out the mono-alkali metal salt by acidification. The process results in the procurement of higher yields of the desired product and in the formation of less by-products.

11 Claims, No Drawings

PROCESS FOR THE PREPARATION OF 1-AMINO-8-NAPHTHOL-3,6-DISULPHONIC ACID (H-ACID)

The present invention relates to a process for the preparation of 1-amino-8-naphthol-3,6-disulphonic acid (H-acid), in the form of a mono-alkali metal salt, from 1-naphthylamine-3,6-trisulphonic acid by alkaline hydrolysis under pressure.

1-Amino-8-naphthol-3,6-disulphonic acid, which is frequently designated H-acid, is an important intermediate product for the preparation of dyestuffs (see Ullmanns Enzyklopädie der Technischen Chemie (Ullmann's Encyclopaedia of Industrial Chemistry), 3rd edition, volume 12, page 621).

It is known from FIAT Final Report No. 1,016, page 32 to 39, that H-acid can be prepared as follows: naphthalene is reacted with sulphuric acid monohydrate (=100% strength $H_2SO_4$) and 65% strength oleum, a particular temperature programme being maintained and sulphuric acid monohydrate and oleum being added stepwise, to give a naphthalene-trisulphonic acid isomer mixture, which is nitrated with mixed acid. After diluting with water, driving off the nitrous gases and separating off the sulphuric acid in the form of calcium sulphate, the isomer mixture of nitronaphthalene-trisulphonic acids is reduced with iron, and dissolved iron salts are then precipitated with magnesium oxide and separated off. The acid calcium sodium salt of T-acid (1-naphthylamine-3,6,8-trisulphonic acid) is precipitated by adding rock salt and hydrochloric acid and is filtered off and washed several times. This salt of T-acid is introduced into the wash water and sodium carbonate is added. The chalk which has precipitated is then pressed out and the salt solution is concentrated. The concentrated solution of the trisodium salt of T-acid is reacted with 50% strength sodium hydroxide solution under pressure. Thereafter, first sulphonic acid and then water are added and the H-acid is finally isolated, as the monosodium salt, by filtration, washing and drying.

In this process, considerable amounts of by-products are formed during the alkaline hydrolysis under pressure of T-acid, for example 1-amino-6-naphthol-3,8-disulphonic acid, an isomer of H-acid known by the name W-acid, and 1,8-dihydroxy-naphthalene-3,6-disulphonic acid, a secondary product of H-acid known by the name chromotropic acid. In general, the yield of H-acid in the process described above is only 70 to 72%, relative to T-acid employed.

According to the present invention there is provided a process for the preparation of a mono-alkali metal salt of 1-amino-8-naphthol-3,6-disulphonic acid comprising reacting 1-naphthylamine-3,6,8-trisulphonic acid and/or a salt thereof and/or a naphthylamine-trisulphonic acid isomer mixture and/or salt thereof with an alkali metal hydroxide solution at elevated pressure and elevated temperature and in the presence of an alcohol or alcoholate, and separating out the mono-alkali metal salt by acidification.

1-Naphthylamine-3,6,8-trisulphonic acid (T-acid) can be employed in the process according to the invention in the pure form and/or in the form of naphthylamine-trisulphonic acid isomer mixtures. In general, the naphthylamine-trisulphonic acid isomer mixtures contain over 65% by weight of 1-naphthylamine-3,6,8-trisulphonic acid, relative to the total amount of diazotisable substance. When naphthylamine-trisulphonic acid isomer mixtures are employed, those which contain 70 is 90% by weight of 1-naphthylamine-3,6,8-trisulphonic acid are preferably used. A naphthylamine-trisulphonic acid isomer mixture to be particularly preferably employed contains 75 to 85% by weight of 1-naphthylamine-3,6,8-trisulphonic acid, 5to 15% by weight of 1-naphthylamine-3,5,7-trisulphonic acid, 1 to 10% by weight of 1-naphthylamine-4,6,8-trisulphonic acid, 0.5 to 5% by weight of 1-naphthylamine-2,5,7-trisulphonic acid, 0.1% to 2% by weight of 2-naphthylamine-3,5,7-trisulphonic acid, 0.1% to 2% by weight of 2-naphthylamine-4,6,8-trisulphonic acid and 0.1% to 2% by weight of 2-naphthylamine-3,6,8-trisulphonic acid.

In addition to the naphthylamine-trisulphonic acids, naphthylamine-trisulphonic acid isomer mixtures can also contain further products. Such products can be, in particular, by-products, decomposition products or unreacted intermediate products from the preparation stages of naphthylamine-trisulphonic acid, for example naphthalene-di-, -tri- and -tetrasulphonic acids, nitronaphthalene-mono-, -di and -trisulphonic acids, naphthylamine-mono- and -disulphonic acids,for example 1-naphthylamine-3,6- and 5,7-disulphonic acid, and furthermore dinaphthylsulphone-sulphonic acids and their amino and nitro derivatives, as well as oxidation products of naphthalene and/or of the naphthalenesulphonic acids which can be formed during the sulphonation and/or the nitration.

1-Naphthylamine-3,6,8-trisulphonicacid or the naphthylamine-trisulphonic acid isomer mixtures can be employed in the free form, in the form of neutral salts or in the form of acid salts. Mixtures which contain the free acids and salts can also be used. If all or some of the 1-naphthylamine-3,6,8-trisulphonic acid or naphthylamine-trisulphonic acid isomer mixtures are present as salts, the alkali metal salts and alkaline earth metal salts, in particular the sodium salts and potassium salts, are preferred.

1-Naphthylamine-3,6,8-trisulphonic acid, or salts of this acid, suitable for use in the process according to the invention can be obtained by trisulphonating naphthalene, nitrating the mixture formed, reducing the nitro-Naphthalene-trisulphonic acid mixture then present, precipitating the acid calcium sodium salt of T-acid, adding sodium carbonate to a solution of this salt, pressing out the chalk which has precipitated and concentrating the salt solution. These reactions can be carried out by the initially described procedure according to FIAT Final Report No. 1016 or in any other desired manner.

A naphthylamine-trisulphonic acid isomer mixture suitable for use in the process according to the invention can be obtained in a similar manner if the reaction sequence is interrupted after the reduction of the nitro-naphthalene-trisulphonic acid mixture has ended.

The 1-naphthylamine-3,6,8-trisulphonic acid and/or salts thereof and/or the naphthlamine-trisulphonic acid isomer mixture and/or salts thereof can be employed, for example, in the solid form or in the form of an aqueous solution having a content of, for example, 20 to 50% by weight, preferably 30 to 40% by weight, calculated as the free acid with the molecular weight 383.

Alkali metal hydroxide solutions which can be used for the process according to the invention are, in particular, aqueous potassium hydroxide solution or sodium hydroxide solution. Compared with sodium hydroxide solution, using potassium hydroxide solution leads to better yields, but in general sodium hydroxide solution is less expensive. 2.5 to 12 mols of alkali metal hydroxide, for example, can be employed per mol of diazotisable substance (calculated with a molecular weight of 383=T-acid). 6 to 9 mols of alkali metal hydroxide are particularly preferably used per mol of diazotisable substance. The concentration of alkali metal hydroxide in the reaction mixture can be, for example, 10 to 50% by weight (relative to the sum of alkali metal hydroxide plus water plus alcohol). This concentration is preferably 25 to 35%.

It is an essential aspect of the process according to the invention that it is carried out in the presence of an alcohol and/or alcoholate. For this, the alcohol can be added to the reaction mixture in the pure form, mixed with water or in the form of an alcoholate, for example in the form of an alkali metal alcoholate. Suitable alcohols are those alcoholic compounds which under the reaction conditions are water-miscible and do not enter into undesired side reactions, or enter into undesired side reactions only to a slight extent, with the strong alkali. In this case, the formation of an alcoholate is not an undesired side reaction. Aliphatic alcohols with, for for example, 1 to 6 carbon atoms are preferably used. Examples of alcohols which can be used are primary, secondary and tertiary monohydric and polyhydric alcohols (particularly alkanols, alkane diols and alkane triols), all or some of the hydroxyl groups of which can also be etherified. Said etherified hydroxyl groups are preferably derived from $C_1$–$C_6$ alkanols. Examples of monohydric alcohols which can be used are: methanol, ethanol, n-propanol, 2-propanol, n-butanol, iso-butanol and tert.-butanol. Examples of polyhydric alcohols which can be used are: ethylene glycol, propanediols, butanediols, glycerol, butanetriols, monoglymes and diglymes. It is also possible, of course, to use mixtu4res of alcohols. Methanol is particularly preferably employed.

The amount of alcohol or alcoholate to be employed can be chosen, for example, such that 10 to 80% by weight, preferably 25 to 60% by weight, of alcohol or alcoholate, relative to the sum of water plus alcohol, are present.

The process according to the invention can be carried out, for example, at temperatures from 150° to 250° C., preferably at 180° to 220° C., in a closed vessel. The pressure thereby set up is generally completely sufficient to carry out the process according to the invention in a satisfactory manner. It is also possible, of course, to carry out the process according to the invention at other pressures than those which are automatically set up in closed vessels. For example, pressures in the range from 5 to 100 bars are possible for the process according to the invention.

The reaction time largely depends on the reaction temperature and the alkali metal hydroxide concentration. It is shorter at relatively high reaction temperatures and at relatively high alkali metal hydroxide concentrations and longer at relatively low reaction temperatures and relatively low alkali hydroxide concentrations, and in general is 10 minutes to 10 hours. For example, good results are obtained with a reaction time of 45 to 60 minutes at a reaction temperature of about 200° C. and an alkali metal hydroxide concentration of 30% by weight.

The substances to be employed in the process according to the invention are most appropriately introduced into the reactor vessel at a temperature such that after the heat of mixing and, if appropriate, the heat of neutralisation has been released, the temperature is the desired reaction temperature. The substances to be introduced can also be brought together at relatively low temperatures and heated to the desired reaction temperature in the reaction vessel.

After the reaction has ended and before the H-acid is separated out as the mono-alkali metal salt, it is advantageous to cool the reaction mixture and/or to dilute it with water. The mixture can be cooled, for example, to temperatures in the range from 20° to 150° C., preferably to temperatures in the range from 80° to 120° C. The amount of water to be appropriately added depends on the reaction conditions, for example the nature of the alkali metal hydroxide and its amount and concentration, and the amount of alcohol which may also be present. It is advantageous to choose the amount of water such that the alkali metal sulphite formed during the reaction is dissolved or remains dissolved.

The H-acid is separated out as the mono-alkali metal salt by acidifying the reaction mixture with mineral acids.

Sulphuric acid is preferably used for this. An amount of mineral acid is added such that the sparinly soluble mono-alkali metal salt of H-acid forms. By appropriately choosing the concentration of the mineral acid and/or by adding water before and/or during the addition of the mineral acid, it is appropriately ensured that the inorganic salt which forms, for example sodium sulphate or potassium sulphate, does not precipitate. Good results are obtained, for example, if, in order to separate out the H-acid as the mono-alkali metal salt, the pH is adjusted to a value in the range from 0 to 4, preferably 0.5 to 2.5, and 0.1 to 5 times, preferably 0.5 to 2 times, the amount of water is introduced, relative to the weight of the mixture present in the hydrolysis under pressure, by diluting with water and/or by appropriately choosing the concentration of the mineral acid. The mono-alkali metal salt of H-acid can be separated off in the customary manner, for example by filtration. It is advantageous to adjust the temperature to less than 80° C. by cooling, for example by evaporative cooling, before separating off the mono-alkali metal salt of H-acid, and to carry out the separation at a temperature of less than 80° C. The separation is preferably carried out at a temperature in the range from 20° to 60° C.

In order to completely remove sulphur dioxide, after adjusting the precipitation conditions and before separating off the mono-alkali metal salt of H-acid it is advantageous for the acidified and diluted mixture to be boiled under reflux, or to be kept under a vacuum, for some time, for example 0.5 to 2 hours, or for the sulphur dioxide to be blown out with an inert gas, for example nitrogen.

The mono-alkali metal salt of H-acid present after the separation is usually washed with water, and is dried, for example in vacuo.

After the reaction, the alcohol can be separated off during the working up of the reaction mixture at various stages. It is possible to separate off the alcohol from the alkaline, neutral or acid solution, before or after separating off the H-acid as the mono-alkali metal salt. The alcohol is preferably separated off from the alkaline or neutral solution and by distillation. It is particularly preferably to distil off the alcohol directly from the reaction mixture, appropriately after cooling and/or diluting with water, over a column. If low-boiling alcohols are used, for example methanol, it can suffice to start the distillation by letting down the pressure, without supplying external heat. If the alcohol used demixes out of the reaction mixture, by forming its own phase, at temperatures which are lower than the reaction temperature, it is possible to separate off the alcohol by a simple phase separation after cooling the reaction mixture.

The alcohol separated off is preferably reused in the process according to the invention. It is then only necessary appropriately, to replace the proportion of alcohol lost, during the alkaline hydrolysis under pressure and/or during working up.

Compared with known processes for the preparation of 1-amino-8-naphthol-3,6-disulphonic acid (H-acid) as a mono-alkali metal salt, the process according to the invention has the advantage that higher yields can be achieved and the formation of by-products, in particular the formation of 1-amino-6-naphthol-3,8-disulphonic acid (W-acid) and the formation of 1,8-dihydroxynaphthalene-3,6-disulphonic acid (chromotropic acid) is considerably decreased. The decreased content of W-acid, which is sparinly soluble in acid solution, additionally makes it possible to isolate the mono-alkali metal salt of H-acid in a particularly pure form without intensive washing, which is associated with yield losses.

EXAMPLES

Example 1

450 g of trisodium 1-naphthylamine-3,6,8-trisulphonate (content: 15.3 g of nitrite/100 g and 85.1% by weight of 1-naphthylamine-3,6,8-trisulphonic acid of molecular weight 383; a total of 69 g of nitrite), 325 g of water and 310 g of methanol are initially introduced into a 2.7 l nickel autoclave and the mixture is heated to 200° C. 480 g of 70% strength sodium hydroxide solution (81.4 mols of NaOH) are heated to 220° C. in a 1.3 l steel autoclave and are forces, using nitrogen, into the 2.7 l autoclave whereupon a 30% strength by weight sodium hydroxide solution, relative to the sum of water+methanol, is formed. A temperature of 220° C. is thereby set up. The reaction mixture is kept at 220° C. for 15 minutes and cooled as rapidly as possible, the methanol is distilled off over a column and the melt is allowed to run into a hot mixture of 600 g of sulphuric acid and 2 l of water. The resulting suspension is boiled under reflux for one hour in order to remove sulphur dioxide, then cooled to 40° to 45° C. and kept at 40° to 45° C. for a further hour. The product which has precipitated is filtered off at 40° C., washed with a total of 500 g of water and dried in vacuo at 80° C. The yield is 82% of theory. The quality of the H-acid was determined by high pressure liquid chromatography to be as follows:

| | |
|---|---|
| monosodium salt of H-acid: | 84.2% |
| monosodium salt of 1-naphthylamine-3,6-disulphonic acid: | 0.2% |
| monosodium salt of W-acid: | — |
| disodium salt of chromotropic acid: | 1.1% |
| disodium salt of T-acid: | 0.4% |
| water: | 8.7% |
| sodium sulphate: | 5.6% |

Examples 2to 2n

Several reactions carried out as in Example 1 varying the reaction parameters 1. molar ratio of NaOH to the trisodium salt of T-acid
2. NaOH concentration, relative to water+methanol
3. weight ratio of water to methanol
4. temperature
5. reaction time give the result summarised in Table 1.

TABLE 1

| | Reaction conditions | | | | | Yield | Quality+) | | | | |
|---|---|---|---|---|---|---|---|---|---|---|---|
| Example | Molar ratio of NaOH to T-acid (= 1-naphthylamine-3,6,8-trisulphonic acid) | NaOH concentration relative to water plus methanol, % by weight | Weight ratio of water to methanol | Temperature °C. | Time minutes | Relative to T-acid % | H-acid MW 319 % | 1-naphthylamine-3,6-disulphonic acid MW 303 % | W-acid MW 319 % | Chromotropic acid MW 320 % | T-acid MW 383 % |
| 2a | 8.8:1 | 30 | 4:1 | 200 | 55 | 77 | 80.4 | 0.1 | ϕ | 0.8 | 0.2 |
| b | 8.4:1 | 30 | 7:3 | 220 | 18 | 81 | 80.4 | 0.1 | ϕ | 0.9 | ϕ |
| c | 8.4:1 | 30 | 3:2 | 220 | 15 | 82 | 78.7 | 0.1 | ϕ | 0.9 | 0.4 |
| d | 8.4:1 | 25 | 1:1 | 220 | 22 | 79 | 72.9 | 0.2 | ϕ | 0.8 | 0.1 |
| e | 8.3:1 | 30 | 3:2 | 215 | 18 | 80 | 84.3 | 0.2 | ϕ | 0.3 | 0.5 |
| f | 8.3:1 | 25 | 3:2 | 220 | 22 | 82 | 79.1 | 0.2 | ϕ | 1.1 | 0.2 |
| g | 8.4:1 | 22 | 1:1 | 215 | 25 | 82 | 80.4 | 0.1 | ϕ | 0.6 | 0.4 |
| h | 8.3:1 | 20 | 1:1 | 220 | 25 | 80 | 75.3 | 0.1 | ϕ | 1.3 | 0.5 |
| i | 8.2:1 | 30 | 3:2 | 195 | 65 | 82 | 84.6 | 0.1 | ϕ | 0.7 | 0.5 |
| k | 8.9:1 | 30 | 3:2 | 200 | 55 | 83 | 82.5 | 0.2 | ϕ | 0.4 | 0.2 |
| l | 5.9:1 | 30 | 3:2 | 200 | 70 | 80 | 80.8 | 0.2 | ϕ | 0.8 | ϕ |
| m | 6.6:1 | 30 | 3:2 | 200 | 60 | 80 | 83.9 | 0.2 | ϕ | 0.4 | 0.3 |
| n | 8.6:1 | 25 | 3:2 | 200 | 65 | 80 | 81.6 | 0.1 | ϕ | 0.4 | 0.2 |

+)Virtually only water and sodium sulphate are also present to make up to 100%. The contents of the organic acids indicated are calculated with respect to the free acids. In fact, these are present in the form of the salts indicated in Example 1.

Example 3

513 g of the tripotassium salt of T-acid (content: 13.4 g of nitrite/100 g and 74.7% by weight of T-acid of molecular weight 383; a total of 69 g of nitrite), 325 g of water and 315 g of methanol are heated to 210° C. in a 2.7 l nickel autoclave. 480 g of 70% strength by weight potassium hydroxide solution (6.0 mols of KOH), having a temperature of 210° C., are forced in, using nitrogen, analogously to Example 1. A temperature of 220° C. is thereby set up and a 30% strength by weight KOH solution, relative to water+methanol, results. The reaction mixture is kept at 220° C. for 17 minutes and cooled to 150° C. in the course of about 2 minutes by means of a cooling coil. After further cooling, the methanol is distilled off and the reaction solution is allowed to run into a hot mixture of 450 g of sulphuric acid and 5.5 kg of water. The reaction mixture is stirred at 100° to 110° C. for 2 hours in order to remove sulphur dioxide, cooled to room temperature and stirred at room temperature for 1 hour. The product is filtered off, washed with a total of 500 g of water and dried in vacuo at 80° C. The yield is 88% of theory. The quality of the H-acid was determined by high pressure liquid chromatography to be as follows:

| | | |
|---|---|---|
| monopotassium salt of H-acid: | | 88.0% |
| monopotassium 1-naphthylamine-3,6-disulphonate: | | 0.05% |
| monopotassium salt of W-acid: | | — |
| dipotassium salt of chromotropic acid: | | — |
| dipotassium salt of T-acid: | | — |
| water: | | 11.6% |
| potassium sulphate: | less than | 0.4% |

Examples 4a to 4m

Several reactions carried out as in Example 3 varying the reaction parameters 1. molar ratio of KOH to the tripotassium salt of T-acid
2. KOH concentration, relative to water+methanol
3. weight ratio of water to methanol
4. temperature
5. reaction time gave the results summarised in Table 2.

TABLE 2

| Ex-ample | Reaction conditions: Molar ratio of KOH to T-acid | KOH concentration relative to water plus methanol, % by weight | Weight ratio of water to methanol | Temperature °C. | Time minutes | Yield: Relative to T-acid % | Quality+): H-acid MW 319 % | 1-naphthylamine-3,6-disulphonic acid MW 303 % | W-acid MW 319 % | Chromotropic acid MW 320 % | T-acid MW 383 % |
|---|---|---|---|---|---|---|---|---|---|---|---|
| 4a | 3.5:1 | 30 | 3:2 | 220 | 30 | 84 | 77.2 | 0.1 | ϕ | 0.6 | ϕ |
| b | 4:1 | 30 | 3:2 | 220 | 20 | 86 | 80.1 | 0.1 | ϕ | ϕ | ϕ |
| c | 5:1 | 30 | 3:2 | 220 | 17 | 87 | 77.1 | 0.2 | ϕ | 0.6 | 0.1 |
| d | 6:1 | 30 | 3:2 | 220 | 15 | 88 | 78.2 | ϕ | ϕ | 0.2 | ϕ |
| e | 8:1 | 30 | 3:2 | 220 | 13 | 87 | 79.0 | 0.1 | ϕ | ϕ | ϕ |
| f | 12:1 | 30 | 3:2 | 220 | 13 | 87 | 78.1 | 0.2 | ϕ | ϕ | ϕ |
| g | 3.5:1 | 25 | 3:2 | 200 | 130 | 83 | 76.1 | ϕ | ϕ | 0.5 | ϕ |
| h | 3.5:1 | 30 | 3:2 | 200 | 90 | 86 | 77.7 | 0.2 | ϕ | 0.5 | 0.1 |
| i | 3.5:1 | 30 | 3:2 | 190 | 200 | 82 | 75.3 | 0.2 | ϕ | 0.5 | 0.2 |
| k | 6:1 | 30 | 3:2 | 190 | 150 | 88 | 78.3 | 0.1 | ϕ | ϕ | ϕ |
| l | 8:1 | 30 | 3:2 | 190 | 125 | 89 | 78.7 | 0.1 | ϕ | ϕ | ϕ |
| m | 12:1 | 30 | 3:2 | 190 | 115 | 90 | 79.9 | 0.1 | ϕ | 0.3 | 0.2 |

+)Virtually only water and potassium sulphate are also present to make up to 100%. The contents of the organic acids indicated are calculated with respect to the free acids. In fact, they are present in the form of the salts indicated in Example 3.

Example 5 (according to FIAT Final Report ibid.)

A reaction carried out as in Example 1 using trisodium 1-naphthylamine-3,6,8-trisulphonate, but in which the methanol is replaced by the same amount by weight of water, gives a yield of 73% of theory. The contents of the isolated product were determined by high pressure liquid chromatography to be as follows:

| | |
|---|---|
| H-acid: | 82.3% |

-continued

| | |
|---|---|
| 1-naphthylamine-3,6-disulphonic acid: | 0.2% |
| W-acid: | 1.9% |
| chromotropic acid: | 1.2% |
| T-acid: | 0.5% |

These contents are calculated relative to the free acids. In fact these are present in the form of the salts indicated in Example 1.

Example 6

4.5 g of the trisodium salt of T-acid (content: 15.3 g of nitrite/100 g and 85.1% by weight of T-acid of molecular weight 383; a total of 0.69 g of nitrite) are suspended in a mixture of 30 g of sodium hydroxide, 42 g of water and 28 g of the alcohol indicated and the suspension is kept at 215° C. for 20 minutes, whilst shaking. The composition of the reaction mixtures was determined by means of high pressure liquid chromatography. The alcohols used and the contents of the various acids in the reaction mixture can be seen from Table 3 which follows.

Table 3

| Alcohol | H-acid mol % | W-acid mol % | Chromotropic acid mol % | T-acid mol % | 1-Naphthylamine-3,6-disulphonic acid mol % |
|---|---|---|---|---|---|
| water+) | 76 | 3.6 | 8.0 | 0.5 | 1.0 |
| methanol | 86 | 0.8 | 3.7 | ϕ | 2.1 |
| ethanol | 78 | 3.4 | 5.3 | ϕ | 4.0 |
| n-propanol | 78 | 3.4 | 5.1 | ϕ | 3.5 |
| 2-propanol | 77 | 3.6 | 3.7 | ϕ | 3.9 |
| tert.-butanol | 78 | 3.6 | 4.2 | 0.2 | 3.5 |
| methylglycol | 78 | 3.2 | 2.3 | ϕ | 5.0 |

+)not according to the invention

Example 7

Several reactions carried out as in Example 6 using methanol as the alcohol and varying the water/methanol weight ratio give the following composition of the reaction mixtures (see Table 4):

Table 4

| Weight ratio of water to methanol | H-acid mol % | W-acid mol % | Chromotropic acid mol % | T-acid mol % |
|---|---|---|---|---|
| 40:10 | 82 | 1.3 | 7.4 | 1.2 |
| 35:15 | 84 | 1.0 | 6.5 | 0.4 |
| 30:20 | 87 | 0.8 | 4.0 | 0.3 |

Example 8

580 g of a naphthalenetrisulphonic acid mixture in the form of the trisodium salts (content: 11.9 g of total nitrite/100 g and 52.8% by weight of T-acid of molecular weight 383; a total of 69 g of nitrite and 0.80 mol of T-acid) of the following composition:

| | |
|---|---|
| 1-naphthylamine-3,6,8-trisulphonic acid: | 80.0% |
| 1-naphthylamine-3,5,7-trisulphonic acid: | 8.5% |
| 1-naphthylamine-4,6,8-trisulphonic acid: | 4.0% |
| 1-naphthylamine-2,5,7-trisulphonic acid: | 3.0% |
| 2-naphthylamine-3,5,7-trisulphonic acid: | 1.2% |
| 2-naphthylamine-4,6,8-trisulphonic acid: | 0.7% and |
| 2-naphthylamine-3,6,8-trisulphonic acid: | 0.5% |

(the contents in percent are in each case relative to diazotisable substance), which additionally contains 0.3% by weight of disodium 1-naphthalamine-3,6-disulphonate, 1.3% by weight of trisodium naphthalane-1,3,6-trisulphonate, 0.6% by weight of trisodium 1-nitronaphthalene-3,6,8-trisulphonate, 4.6% by weight of water and amounts, which cannot be determined quantitatively, of amino and nitro derivatives of dinaphthylsulphone-sulphonic acid and of oxidation products of naphthalene and of naphthalene-trisulphonic acids, as well as 275 g of water and 280 g of methanol are initially introduced into a 2.7 l nickel autoclave and the mixture is heated to 190° C. 430 g of 70% strength by weight sodium hydroxide solution (7.5 mols of NaOH) are heated to 185° C. in a 1.3 l steel autoclave and are forced, using nitrogen, into the 2.7 l autoclave, whereupon a 30% strength by weight sodium hydroxide solution, relative to water+methanol, is formed. A temperature of 200° C. is thereby set up. The reaction mixture is kept at 200° C. for 45 minutes, cooled and diluted with 500 g of water and the methanol is distilled off. The hot reaction solution is acidified with about 1,000 g of 50% strength by weight sulphuric acid, whilst controlling the pH at pH 1 to 1.5, heated under reflux for 1 hour in order to completely remove sulphur dioxide, cooled to 40° C. with evaporative cooling and kept at 40° C. for 2 hours. The product is filtered off at 40° C., washed with a total of 500 g of water and dried in vacuo at 80° C.

The yield is 62%, relative to T-acid isomer mixture, or 78%, relative to T-acid. The quality of the H-acid was determined by high pressure liquid chromatography to be as follows:

| | |
|---|---|
| H-acid: | 79.5% |
| 1-naphthylamine-3,6-disulphonic acid: | 0.9% |
| W-acid | — |
| chromotropic acid: | 0.3% |
| T-acid: | 0.1% |
| water: | 12.0% |
| sodium sulphate: | 1.0% |

The contents indicated relate to the free acids. In fact, the salts mentioned in Example 1 are present. The isolated product does not contain reaction products from the isomeric naphthylamine-trisulphonic acids.

Example 9

A reaction carried out as in Example 8, but in which the methanol is distilled off after the reaction mixture has been neutralised with sulphuric acid gives a yield of 63%, relative to T-acid isomer mixture, or 79%, relative to T-acid.

Examples 10a to 10i

Several reactions carried out as in Example 8 with a weight ratio of water to methanol of 3:2 in the reaction mixture and varying the reaction parameters 1. molar ratio of NaOH to the trisodium salt of the T-acid isomer mixture,
2. NaOH concentration, relative to water+methanol,
3. temperature
4. reaction time give the results summarised in Table 5.

Table 5

| | Reaction conditions | | | | Yield | | Quality+) | | | | |
|---|---|---|---|---|---|---|---|---|---|---|---|
| Example | Molar ratio of NaOH to T-acid isomer mixture (MW 383) | NaOH concentration relative to water plus methanol, % by weight | Temperature °C. | Time minutes | Relative to T-acid isomer mixture % | Relative to T-acid % | H-acid MW 319 % | 1-naphthylamine-3,6-disulphonic acid MW 303 % | W-acid MW 319 % | Chromotropic acid MW 320 % | T-acid MW 383 % |
| 10a | 8:1 | 30 | 210 | 25 | 63 | 79 | 75.7 | 0.9 | ϕ | 0.5 | ϕ |
| b | 7:1 | 30 | 210 | 25 | 62 | 78 | 77.2 | 0.9 | ϕ | 0.4 | 0.1 |
| c | 8:1 | 25 | 200 | 40 | 63 | 79 | 78.6 | 0.7 | ϕ | 0.4 | 0.2 |
| d | 7:1 | 25 | 200 | 50 | 62 | 78 | 80.6 | 0.8 | ϕ | 0.3 | 0.3 |
| e | 8:1 | 22.5 | 210 | 25 | 61 | 76 | 78.1 | 0.8 | ϕ | 0.4 | 0.2 |
| f | 7:1 | 22.5 | 190 | 120 | 62 | 77 | 78.6 | 1.1 | ϕ | 0.6 | ϕ |
| g | 7.5:1 | 30 | 180 | 160 | 62 | 77 | 81.8 | 0.9 | ϕ | 0.4 | 0.4 |
| h | 7.5:1 | 30 | 190 | 80 | 62 | 77 | 80.4 | 0.8 | ϕ | 0.6 | 0.2 |
| i | 7.5:1 | 30 | 210 | 20 | 63 | 78 | 79.6 | 0.8 | ϕ | 0.2 | 0.5 |

+)Virtually only water and sodium sulphate are also present to make up to 100%. The contents of the organic acids indicated are calculated with respect to the free acids. In fact, the salts indicated in Example 1 are present.

Example 11

5.9 kg of a naphthylamine-trisulphonic acid mixture in the form of the trisodium salts (content: 11.7 g of total nitrite/100 g and 53.9% by weight of T-acid of molecular weight 383, a total of 0.69 kg of nitrite and 8.3 mols of T-acid) of the following composition:

| | |
|---|---|
| 1-naphthylamine-3,6,8-trisulphonic acid | 83.0% |
| 1-naphthylamine-3,5,7-trisulphonic acid | 7.3% |
| 1-naphthylamine-4,6,8-trisulphonic acid | 3.4% |
| 1-naphthylamine-2,5,7-trisulphonic acid | 3.2% |
| 2-naphthylamine-3,5,7-trisulphonic acid | 0.8% |
| 2-naphthylamine-4,6,8-trisulphonic acid | 0.3% and |
| 2-naphthylamine-3,6,8-trisulphonic acid | 0.5% |

(the contents in percent are in each case relative to diazotisable substance), which additionally contains 0.2% by weight of disodium 1-naphthylamine-3,6-disulphonate, 1.1% by weight of trisodium naphthalene-1,3,6-trisulphonate, 5.4% by weight of water and amounts, which cannot be determined quantitatively, of amino and nitro derivatives of dinaphthylsulphone-sulphonic acid and of oxidation products of naphthalene and of naphthalene-trisulphonic acids, as well as 2.8 kg of water and 2.8 kg of methanol are heated to 180° C. in a 20 l nickel autoclave. 4.3 kg of 70% by weight sodium hydroxide solution (75 mols of NaOH), having a temperature of 180° C., are pumped into the autoclave in the course of about 5 minutes, whilst blanketing with nitrogen, whereupon a temperature of 200° C. is set up. The reaction mixture is kept at 200° C. for 55 minutes and let down in a 25 l stainless steel kettle, into which 10 l of cold water have been initially introduced. The methanol is distilled off and the dilute H-acid isomer mixture solution is forced, using nitrogen and in the course of 40 to 60 minutes, into a glass precipitation vessel into which 4 kg of water (or the wash water from the previous batch) have been initially introduced. The pH value is kept at 1 to 1.5 by simultaneously running in about 5.2 kg of sulphunic acid monohydrate (=100% strength sulphuric acid) and the reaction mixture is brought to the boil. The hot acid H-acid suspension is freed from residual sulphur dioxide by applying a vacuum, cooled to 40° C. in the course of one hour, kept at 40° C. for one hour and filtered. The product is washed with a total of 5.4 kg of water and dried in vacuo at 80° C. The yield is 65%, relative to T-acid isomer mixture, or 78%, relative to T-acid. The quality of the H-acid was determined by high pressure liquid chromatography to be as follows:

| | |
|---|---|
| H-acid: | 83.5% |
| 1-naphthylamine-3,6-disulphonic acid: | 1.0% |
| W-acid: | — |
| chromotropic acid: | 0.7% |
| T-acid: | 0.1% |
| sodium sulphate: | 0.8% |
| water: | 8.3% |

The contents of the organic acids indicated are calculated relative to the free acids. In fact the salts indicated in Example 1 are present.

What is claimed is:

1. A process for the preparation of a mono-alkali metal salt of 1-amino-8-naphthol-3,6disulphonic acid which comprises reacting 1-naphthylamine-3,6,8-trisulphonic acid and/or a salt thereof and/or a naphthylamine-trisulphonic acid isomer mixture and/or salt thereof with an aqueous alkali metal hydroxide solution at elevated pressure and elevated temperature and in the presence of an aliphatic alcohol having 1 to 6 carbon atoms or alcoholate thereof, and separating out the mono-alkali metal salt by acidification.

2. A process according to claim 1 wherein the naphthylamine-trisulphonic acid isomer mixture contains from 70 to 90% by weight of 1-naphthylamine-3,6,8-trisulphonic acid.

3. A process according to claim 1 wherein the alcohol is methanol.

4. A process according to claim 1 wherein from 10 to 80% by weight of alcohol and/or alcoholate, based on the weight of water and alcohol and/or alcoholate, is present.

5. A process according to claim 1 wherein the reaction temperature is from 150° to 250° C.

6. A process according to claim 1 wherein the reaction is carried out in a closed vessel.

7. A process according to claim 1 wherein the reaction is carried out under a pressure of from 5 to 100 bars.

8. A process according to claim 1 wherein the acidification is carried out by the addition of sulphunic acid.

9. A process according to claim 1 wherein the mono-alkali metal salt is separated out at a temperature of from 20° to 60° C.

10. A process according to claim 1 wherein, after the reaction is complete, the alcohol is separated off from the reaction mixture by distillation.

11. A process according to claim 10 wherein the alcohol which is separated off is reused.

* * * * *